US006418648B1

(12) United States Patent
Hollingsworth et al.

(10) Patent No.: US 6,418,648 B1
(45) Date of Patent: Jul. 16, 2002

(54) PREPAID CARD IN A PULL OUT ENVELOPE

(75) Inventors: James R. Hollingsworth, Broadview Heights, OH (US); Stacy Poulton, Bountiful, UT (US)

(73) Assignee: Moore North America Inc., Grand Island, NY (US)

( * ) Notice: Subject to any disclaimer, the term of this patent is extended or adjusted under 35 U.S.C. 154(b) by 96 days.

(21) Appl. No.: 09/796,217

(22) Filed: Feb. 28, 2001

(51) Int. Cl.[7] ..... G09F 1/00
(52) U.S. Cl. ..... 40/124.14; 248/459
(58) Field of Search ..... 40/124.08, 124.14, 40/124.19, 539; 248/459, 460

(56) References Cited

U.S. PATENT DOCUMENTS

| | | | |
|---|---|---|---|
| 2,114,824 | A | 4/1938 | Watsky |
| 3,235,988 | A | 2/1966 | Paige |
| 4,337,589 | A | 7/1982 | Volkert et al. |
| 4,657,612 | A | 4/1987 | Schoenleber et al. |
| 4,867,480 | A | 9/1989 | Volkert |
| 4,989,355 | A | 2/1991 | Thomas |
| 5,595,008 | A | 1/1997 | Johnson |
| 5,658,620 | A | 8/1997 | Ross |
| 5,943,800 | A | 8/1999 | Rose |

*Primary Examiner*—Cassandra H. Davis
(74) *Attorney, Agent, or Firm*—Hodgson Russ LLP

(57) ABSTRACT

This invention relates to a fold out, two panel card having a pop-out portion supporting a prepaid card. The two panel card includes an outer two panel portion and an inner two panel portion in registry with the outer portion. The inner two panel portion further includes the pop-out portion supporting the prepaid card. The pop-out portion comprises a first and second pop-out panels extending from the respective panels of the inner two panel portion. The prepaid card is secured to a major portion of one of the pop-out panels and a tongue cut out of the other pop-out panel. The pop-out portion and prepaid card of the inner two panel portion are received inside the outer two panel portion when the inner and outer two panel portions, in registry with each other, are folded together. Unfolding the in registry two panel portions causes the pop-out portion and prepaid card to lie flat, co-planar with the unfolded panels, wherein the longitudinal axis of the prepaid card is parallel to the longitudinal axis of the two panel card.

4 Claims, 6 Drawing Sheets

PREPAID CARD IN A PULL OUT ENVELOPE

BACKGROUND OF THE INVENTION

1. Field of the Invention

The present invention relates to a prepaid card gift envelope device containing a pop-out portion supporting a prepaid card.

2. Prior Art

There has been an increased need for a promotional piece where a pop-out is created between facing pages of a folder, which upon opening generally moves upward or downward and outward of the plane of the folder pages. Previous attempts in this area have produced promotional pieces of cumbersome construction requiring either attaching the pop-out piece via an adhesive, or through a multi-step, very arduous process including folding and gluing. These processes are disclosed in the prior art.

Specifically, in U.S. Pat. No. 3,235,988, Paige discloses a pop-up card constructed of two pieces, including a rod attaching a pop-out piece to the card by glue or other adhesive. The current invention obviates the need for using an adhesive or connecting member, thus increasing the ease of construction.

Also, in U.S. Pat. 4,867,480, Volker discloses a pop-out placard display. The invention consists of a pair of base pieces which are hinged along a center line of interconnection. A pop-up assembly supporting a placard is glued between the two base pieces. In the folded condition, the pop-out assembly lies substantially flat and hidden between the base pieces that together can be viewed as a folder. When the folder is opened by pivoting one of the base pieces relative to the other, the pop-out assembly rises up out of the respective planes of the base pieces, with the placard being prominently displayed. However, in the current invention it is not necessary to glue the pop-out assembly between the two base pieces.

The problem with the prior art construction is that adhesive or other means of attachment is necessary to attach the pop-out panel to the body of the card. This invention eliminates the need for gluing by incorporating the pop-out as part of the panel portion.

SUMMARY OF THE INVENTION

This invention relates to a fold out, two panel card having an integral pop-out portion supporting a prepaid card. The two panel card includes an outer two panel portion and an inner two panel portion in registry with the outer portion. The inner two panel portion further includes the integral pop-out portion supporting the prepaid card. The pop-out portion comprises a first and second pop-out panels extending from the respective panels of the inner two panel portion. The prepaid card is secured to a major portion of one of the pop-out panels and a tongue cut out of the other pop-out panel. The pop-out portion and prepaid card of the inner two panel portion are received inside the outer two panel portions when the inner and outer two panel portions in registry with each other are folded together. Unfolding the in registry two panel portions causes the pop-out portion and prepaid card to rotate and lie flat, co-planar with the unfolded panels, wherein the longitudinal axis of the prepaid card is parallel to the longitudinal axis of the two panel card.

The foregoing and additional advantages and characterizing features of the present invention will become clearly apparent upon reading of the ensuing description together with the included drawings wherein:

BRIEF DESCRIPTION OF THE DRAWING FIGURES

BEST MODE FOR CARRYING OUT THE INVENTION

Figure 1:
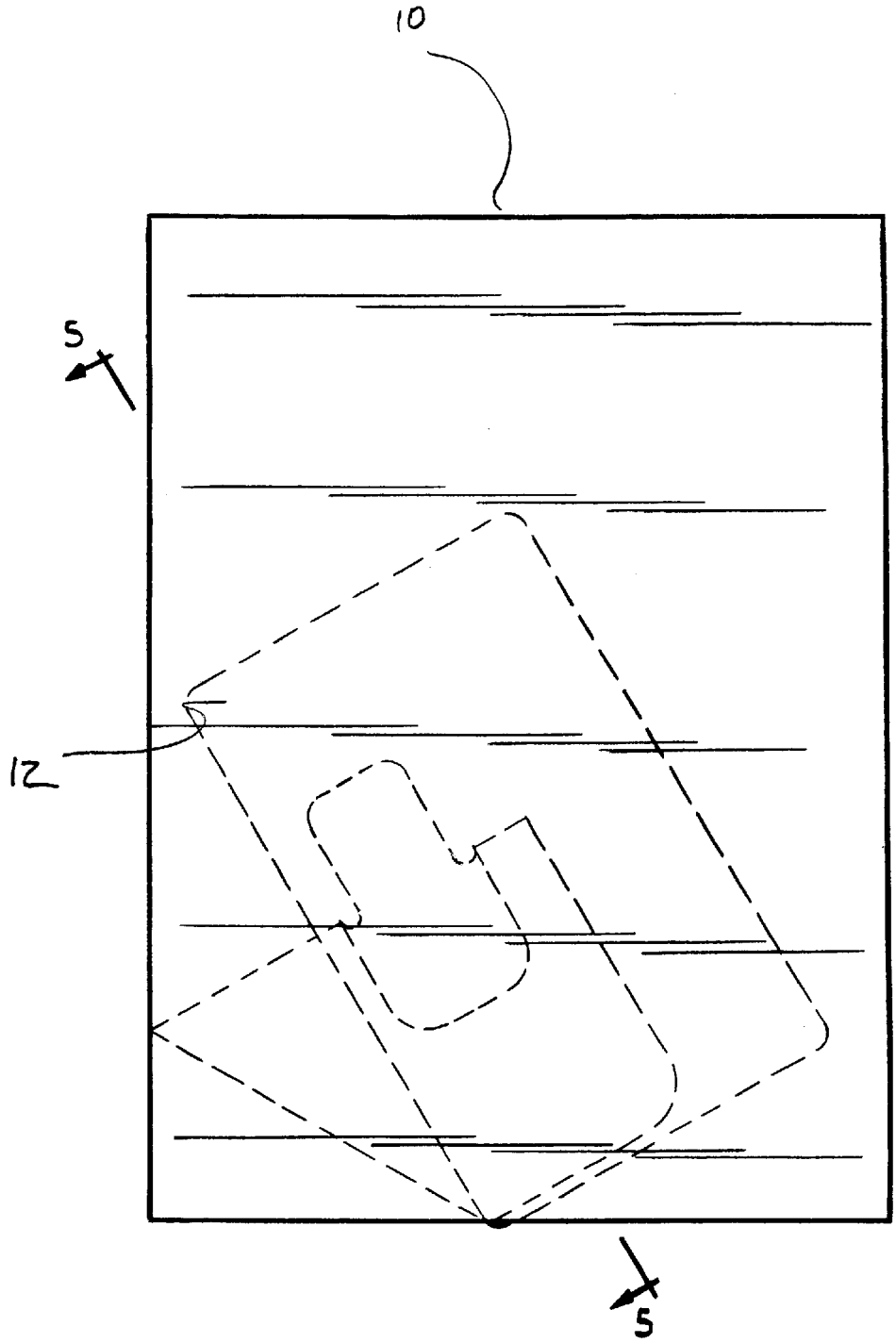
FIG. 1 is a perspective view of the card in a closed position, outlining the pop-up piece inside the card halves.

Turning now to the drawings, FIG. 1 shows a closed prepaid gift envelope 10 according to the present invention. The gift envelope 10 houses a prepaid card 12, which can be a prepaid phone card, and prepaid credit card, a prepaid debit card and the like. It can be appreciated by those skilled in the art that an optimum grade of paper can be used to construct the main body 14. The preferred grade of paper is SBS 14 point.

Figure 6:
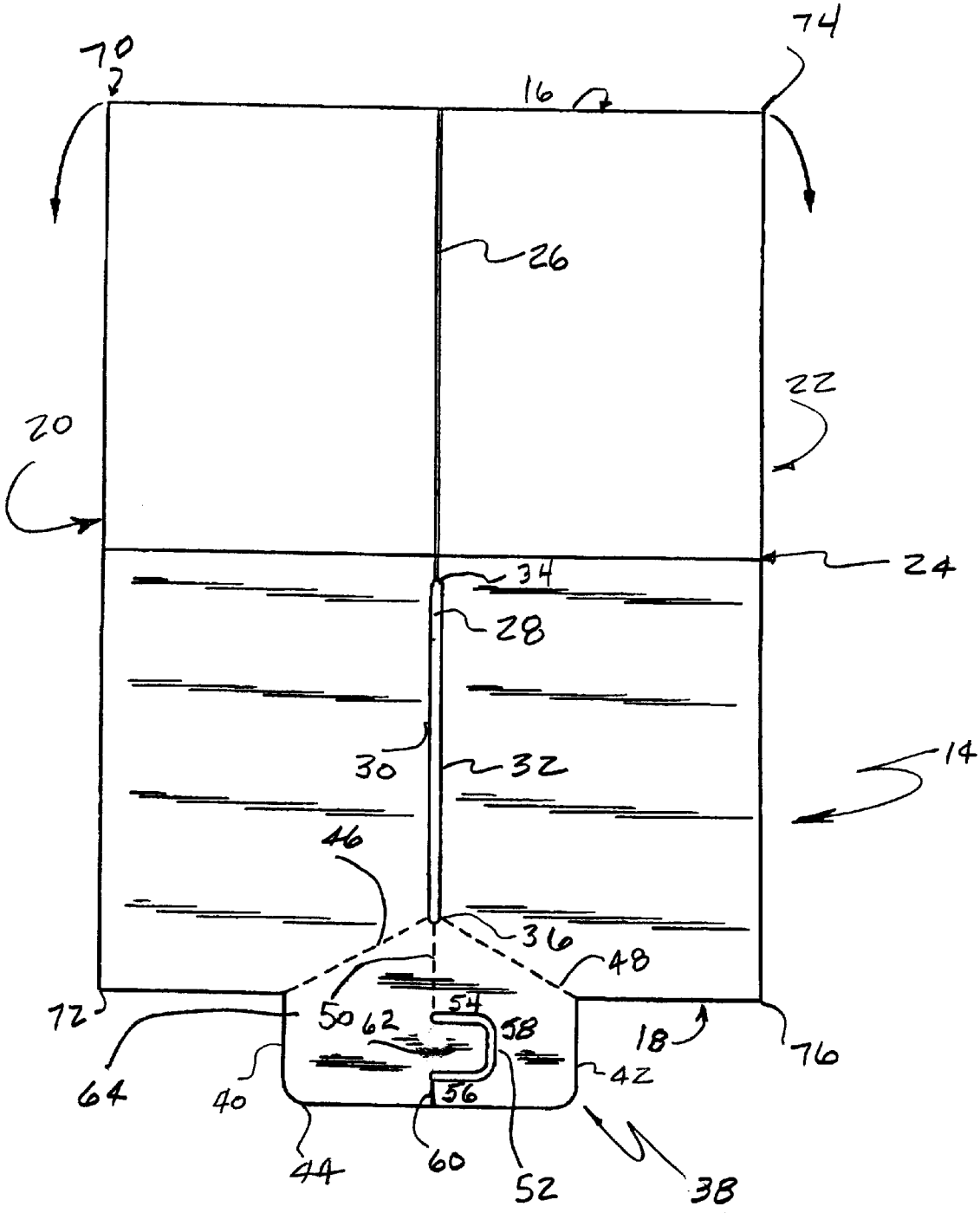
FIG. 6 shows a plan view of one face of the paper material form prior to folding into a finished gift envelope.

As shown in FIG. 6, the prepaid gift envelope 10 begins as a sheet of paper having a main body 14 of a generally rectangular shape. The main body 14 has spaced apart upper and lower edges 16 and 18 extending to and meeting with spaced apart left and right edges 20 and 22. A first fold line 24 intersects the left and right edges 20, 22 and is provided mid way between the upper and lower edges 16 and 18 and parallel thereto. A second fold line 26 extends from the mid point of the upper edge 16 to just below the first fold line 24 where it intersects with an oval opening 28. The second fold line 26 is parallel to the left and right edges 20, 22.

The oval opening 28 is centered between the left and right edges 20, 22 and includes a left edge 30 and a right edge 32, both extending to and meeting with a curved upper edge 34 adjacent to the first fold line 24, and a curved lower edge, adjacent to lower edge 18. The lengths of left and right edges 30, 32 of the oval opening 28 are substantially longer than the length of the curved upper and lower edges 34, 36.

Extending downwardly from the lower edge 18 of the main body 14 is a flap 38. Flap 38 includes spaced apart left and right edges 40, 42, each extending to and meeting with a lower edge 44 at rounded corners. The left edge 40 of flap 38 is parallel to the left edge 20 of the main body 14 and spaced inwardly therefrom. Similarly, the right edge 42 is parallel to the right edge 22 of the main body 14 and spaced inwardly therefrom. The lower edge 44 of the flap 38 is generally parallel to the upper and lower edges 16, 18 of the main body 14.

A first perforation line 46 extends from the junction of the left edge 30 and curved lower edge 36 of the oval opening 28 to the junction of the lower edge 18 of the main body 14 and the left edge 40 of the flap 38. Similarly, a second perforation line 48 extends from the junction of the right edge 32 and the curved lower edge 36 of the oval opening 28 to the junction of the lower edge 18 of the main body 14 and the right edge 42 of the flap 38. A third perforation line 50 extends from the lowest point on the curved lower edge 36 of the oval opening 28 to the upper edge of a backwardly facing C-shaped opening 52 cut into the flap 38.

The C-shaped opening 52 has spaced apart upper and lower legs 54 and 56 extending to and meeting with an intermediate portion 58. The upper and lower legs 54 and 56 of the backwardly facing C-shaped opening 52 are parallel to the upper and lower edges 16 and 18 of the main body 14 while the intermediate portion 58 is adjacent to and parallel with the right edge 42 of flap 38. A fold line 60 extends from the inner end of the lower leg 56 of the opening 52 to the lower edge 44 of flap 38. In that manner, the backwardly facing C-shaped opening 52 forms a tongue 62 defined in the flap 38 and extending from and continuous with a left portion 64 of the flap 38. The left flap portion 64 is delineated by the first and third perforation lines 46, 50 and the fold line 60.

Figure 4:
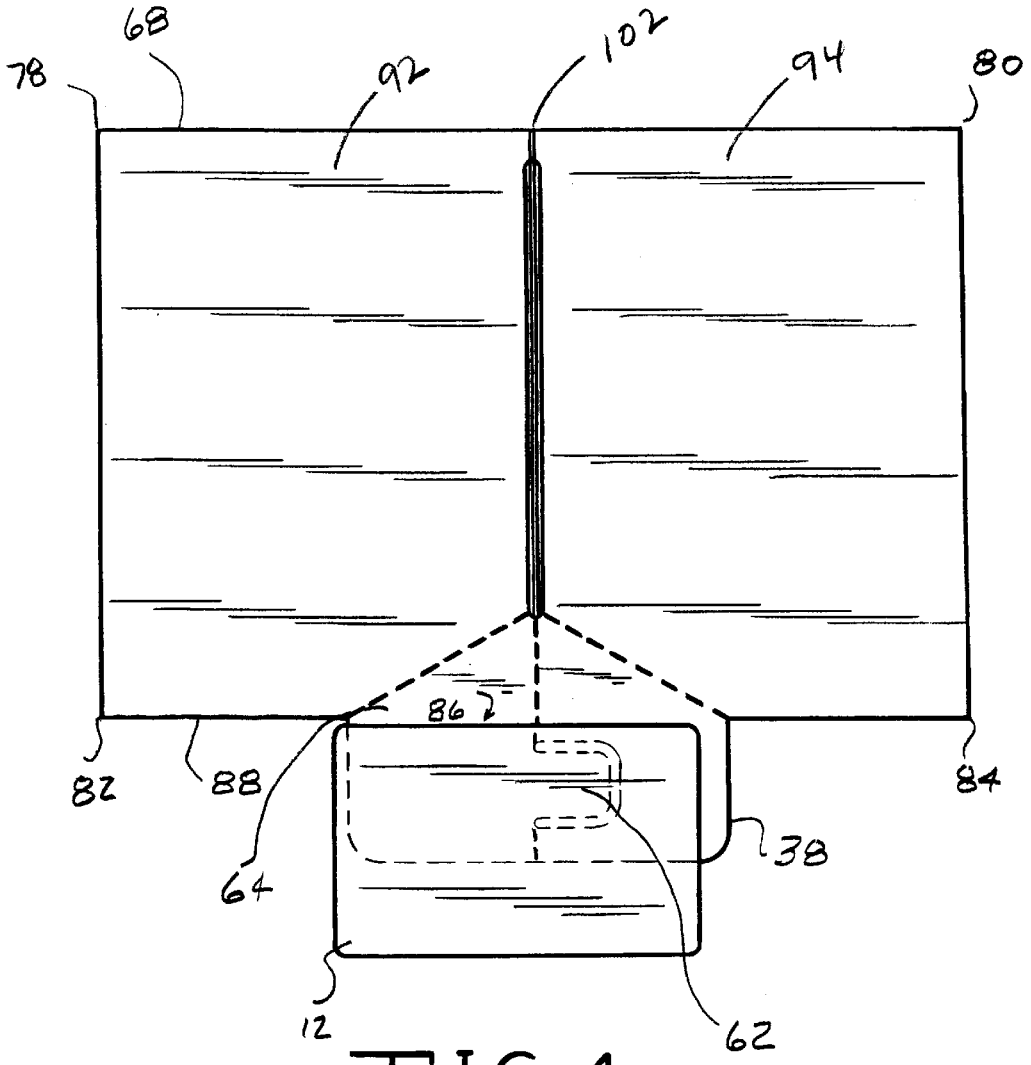
FIG. 4 shows the card fully open with the pop-out mechanism coplanar with the card panels.

As further shown in FIG. 4, the main body 14 is folded in half along the fold line 24 to provide the gift envelope 10 by bringing the upper edge 16 into alignment with the lower edge 18 to form an aligned edge 68. In that manner, the envelope 10 comprises the corner 70 formed at the junction of the upper and left edges 16, 20 of the main body coinciding with the corner 72 formed at the junction of the left and lower edges 20, 18 of the main body 14. Similarly, the corner 74 formed at the junction of the upper and right edges 16, 22 of the main body coincides with the corner 76 formed at the junction of the right and lower edges 16, 18 of the main body. This provides the gift envelope 10 having a fold line left corner 78, a fold line right corner 80, a coinciding left corner 82 and a coinciding right corner 84.

As shown in FIGS. 1 to 4, the flap 38 supports a prepaid credit card 12 of the type used to credit prepaid phone calls, gas purchases and other merchandise and service purchases. The credit card 12 has its upper edge 86 parallel to and spaced somewhat below the coinciding lower edge 88 of the main body. The credit card is supported in the position by the left flap portion 64 and the tongue 62.

Figure 2:
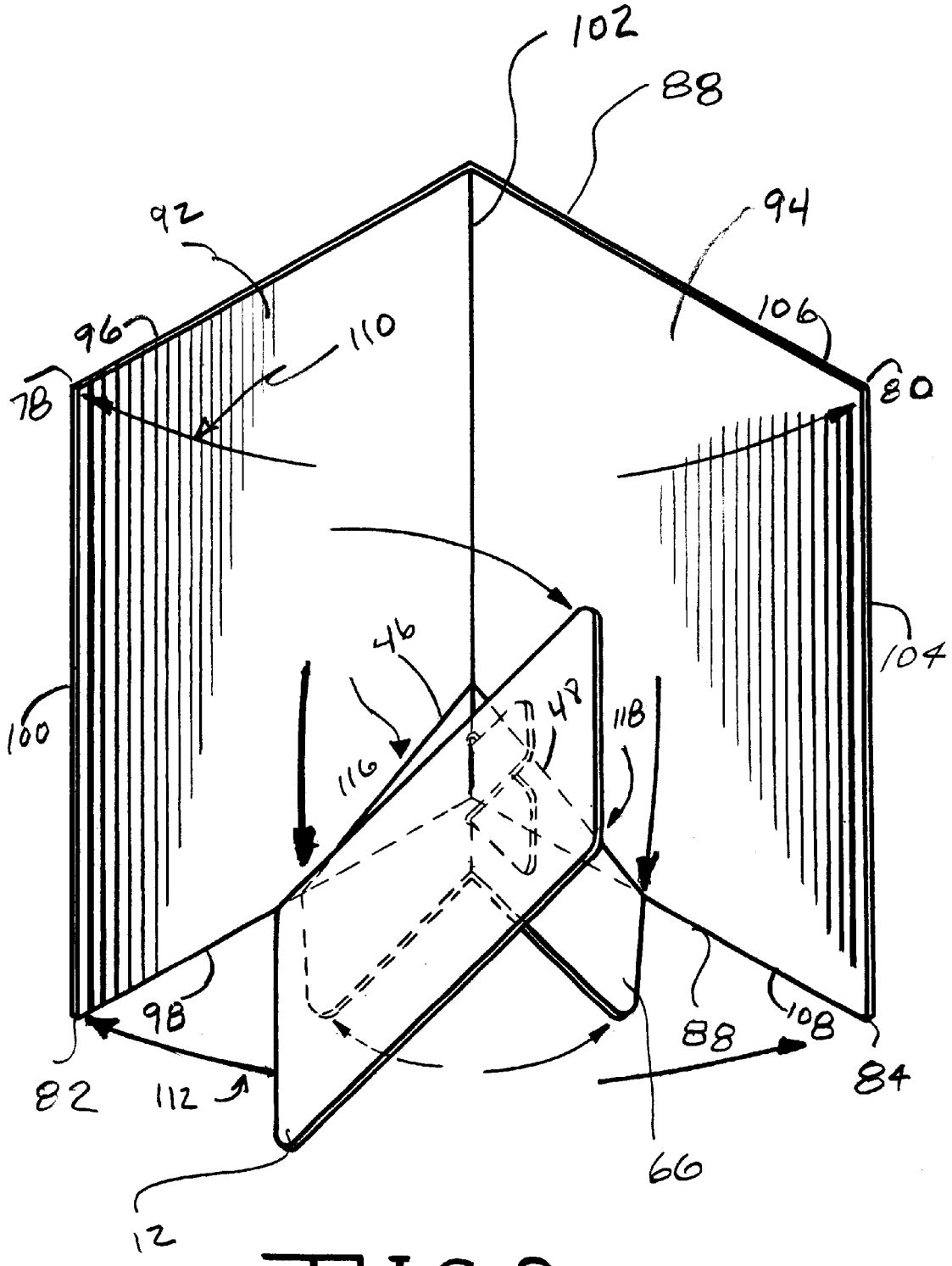
FIG. 2 shows the card partially open with the pop-out mechanism partially unfolded.
Figure 3:
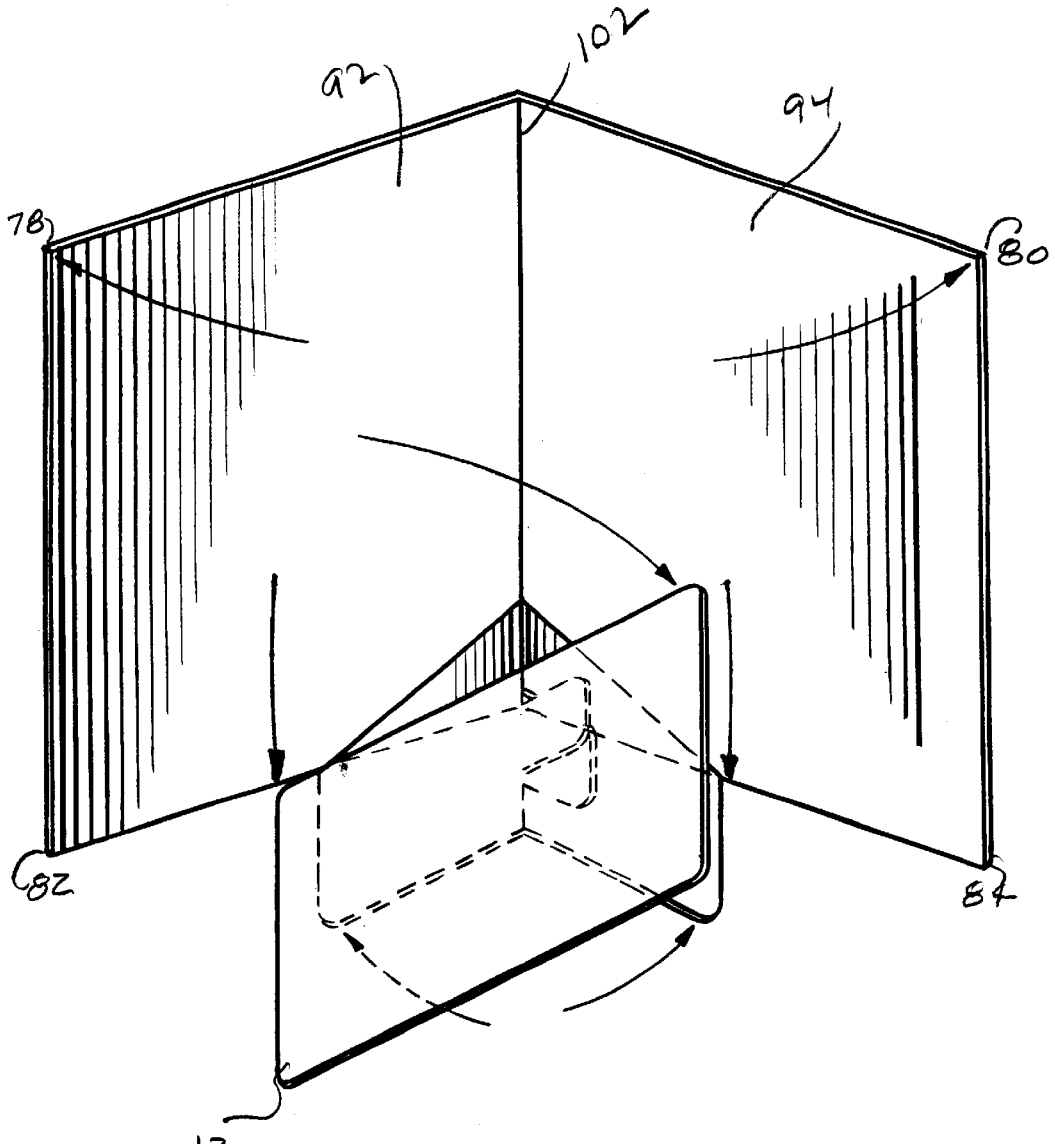
FIG. 3 shows the card almost open with further extension of the pop-out mechanism.

As shown in FIGS. 2 to 4, the gift envelope 10 has left and right panels 92 and 94. The left panel is defined by spaced apart upper and lower edges 96 and 98, extending to and meeting with left edge 100 and fold line 102. The fold line 102 is parallel to the left and right edges 100 and 104 of the gift envelope 10. The fold line extends from aligned edge 68 to the lower coinciding edge 88 of the main body 14. Similarly, the right panel 94 of the gift envelope 10 is defined by spaced apart upper and lower edges 106 and 108, extending to and meeting with right edge 104 and fold line 102.

Figure 5:
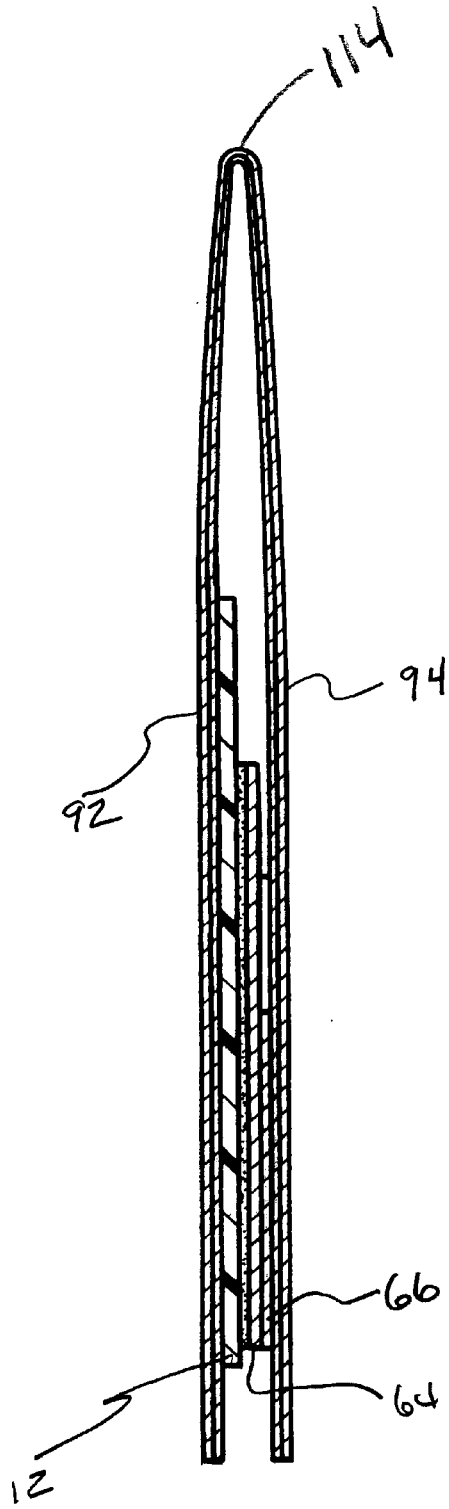
FIG. 5 shows a section cut along axis 5—5 in FIG. 1 depicting the card in the closed position detailing the arrangement of the prepaid card, pop-out piece and card panels.

In FIG. 5, in the fully closed position, credit card 12 together with the right and left portions of the flap 64 and 66 delineated by the third perforation line 50 and fold line 60, are received within the left and right panels, 92 and 94, of card 10. Panels 64 and 66 are superimposed upon each other together with left and right panels 92 and 94, all folded along axis of bend 114. With the envelope 10 in the closed position shown in FIGS. 1 and 5, credit card 12 lies coplanar with folded panels 64 and 66 so that the horizontal axis of the credit card is perpendicular to the axis of bend 114.

In FIGS. 2 and 3, as envelope 10 opens from the fully closed position, corners 78 and 82 traverse along parallel axis 110 and 112 away from corners 80 and 84, respectively. Corner 78 is coplanar with corner 80. Similarly, corner 82 is coplanar with corner 84. As the left and right panels 92 and 94 of card 10 are opened, card 12 pivots generally along bend axis 114 in a rotating downward motion extending from the lowest point on the curved lower edge of oval opening 28 to the lower edge 44 of flap 38 generally along the third perforation line. Contemporaneously, the left and right portions of flaps 64 and 66, respectively, rotate in a generally downward motion about the left and right flap rotational axis 116 and 118 starting generally perpendicular to the opening panels 92 and 94 of the card and finishing coplanar with panels 92 and 94 when the card is fully open. The left rotational axis 116 is generally defined along the first perforation line 46 which extends from the junction of the left edge 30 and curved lower edge 36 of oval opening 28 to the junction of the lower edge 18 of the main body 14 and the left edge 40 of flap 38. The right rotational axis 118 is generally defined along the second perforation line 48 which extends from the junction of the right edge 32 and curved lower edge 36 of oval opening 28 to the junction of the lower edge 18 of the main body and the right edge 42 of flap 38.

In the fully open position as shown in FIG. 4, the unfolded panels 92 and 94 are coplanar with unfolded flap 38. Card 12 is attached to the left portion of the flap 64 and tongue 62. The lower edge 87 of credit card 12 is parallel with aligned edge 68 and the lower edges of the left and right panels 98 and 108. A user is now able to remove the prepaid card 12 from the flap to make debit or credit purchases such as for gas, phone calls, merchandise and services, and the like.

While the preferred embodiment of the present invention has been disclosed, it will be appreciated that it is not limited thereto, but may be otherwise embodied within the scope of the following claims.

I claim:

1. A fold-out two-panel card with pop-out portion supporting a credit card comprising:

a two-panel card, with left and right panels, including a two panel outer portion and a two panel inner portion, in registry with said outer portion;

wherein said two-panel inner portion contains a pop-out portion supporting the display card;

said pop-out portion comprising left and right pop-out panels connectedly hinged to each other and to the respective left and right panels of the two panel inner portions;

wherein said display card is secured to a major portion of one of the left and right pop-out panels and a tongue cut from the other of the left and right pop-out panels;

wherein in a closed position, said pop-out portion and display card are received inside the left and right panels of the card; and wherein in an unfolded position, the left and right panel portions causes said pop-out portion to rotate out and contemporaneously rotate downward from a first position to a second position generally coplanar with said left and right panel portions.

2. A fold-out two-panel card according to claim 1, where the two-panel card is made of SBS 14 point paper.

3. A fold-out two-panel card according to claim 1, wherein the display card can be a display credit card or phone card.

4. A method of making a fold-out two-panel card of claim 1, comprising the steps of:

(a) Folding and attaching the inner portion to the outer portion of the card;

(b) Attaching the display card to the major portion of one of the left and right pop-out panels.

* * * * *